United States Patent [19]

Estabrook et al.

[11] Patent Number: 5,050,352

[45] Date of Patent: Sep. 24, 1991

[54] HONING STONE ASSEMBLY

[75] Inventors: Mark R. Estabrook, Rockford; Charles R. Van Sickle, Winnebago, both of Ill.

[73] Assignee: Barnes Drill Co., Rockford, Ill.

[21] Appl. No.: 415,590

[22] Filed: Oct. 2, 1989

[51] Int. Cl.[5] ..... B24D 33/00; B24B 9/02

[52] U.S. Cl. ..... 51/330; 51/338; 51/355

[58] Field of Search ..... 51/330, 331, 338, 339, 51/340, 352, 355, 204, 342–349

[56] References Cited

U.S. PATENT DOCUMENTS

| | | | |
|---|---|---|---|
| 1,755,965 | 4/1930 | Omey | 51/342 |
| 2,443,268 | 6/1948 | Palotsee | 51/344 |
| 3,016,660 | 1/1962 | Gross | 51/346 |
| 3,116,573 | 1/1964 | Vekovius | 51/346 |

FOREIGN PATENT DOCUMENTS

| | | | |
|---|---|---|---|
| 1298896 | 7/1969 | Fed. Rep. of Germany | 51/338 |
| 1929613 | 12/1970 | Fed. Rep. of Germany | 51/338 |
| 0624778 | 9/1978 | U.S.S.R. | 51/338 |

*Primary Examiner*—Frederick R. Schmidt
*Assistant Examiner*—Bruce P. Watson
*Attorney, Agent, or Firm*—Leydig, Voit & Mayer

[57] ABSTRACT

An abrasive honing stick is bonded within a channel-shaped shell which is made of sheet metal and which is secured detachably to a stone holder by a pair of retaining studs. Each stud extends through a hole in the shell, is telescoped into an alined hole in the holder and is clamped by a set screw which, when tightened, cams against the stud to draw the shell inwardly against the holder. The retention studs extend radially from the shell to reduce the circumferential dimension of the overall stone assembly and thereby enable a comparatively large number of assemblies to be placed in a hone body of a given diameter.

15 Claims, 1 Drawing Sheet

HONING STONE ASSEMBLY

BACKGROUND OF THE INVENTION

This invention relates generally to a honing stone assembly for use in a hone body which is adapted to be rotated and reciprocated in order to smooth a bore in a workpiece. A stone assembly of this general type is disclosed in Gross U.S. Pat. No. 3,016,660.

In general, the stone assembly of the invention includes an elongated stick of bonded abrasive particles. The stick is captivated in a channel-shaped shell made of sheet metal and adapted to be secured releasably to a holder which forms part of the hone body. In many prior stone assemblies with channel-shaped sheet metal shells, the shell is secured to the holder by a side clamp which is carried by the holder and which presses against the shell. The side clamp occupies space in the circumferential direction and limits the number of stone assemblies that can be placed in a hone body of a given diameter.

SUMMARY OF THE INVENTION

The general aim of the present invention is to provide a new and improved honing stone assembly having a channel-shaped sheet metal shell which is positively locked to the holder without any side interference thereby to enable a larger number of stone assemblies to be placed in a hone body of given diameter.

Another object of the invention is to fasten the shell to the holder with means which also pull the shell inwardly toward the holder and the hone body in order to retain the shell more securely.

The invention also resides in the unique construction eliminating the presence of loose parts when a worn stone assembly is replaced.

These and other objects and advantages of the invention will become more apparent from the following detailed description when taken in conjunction with the accompanying drawings.

DETAILED DESCRIPTION OF THE PREFERRED EMBODIMENT

Figure 1:
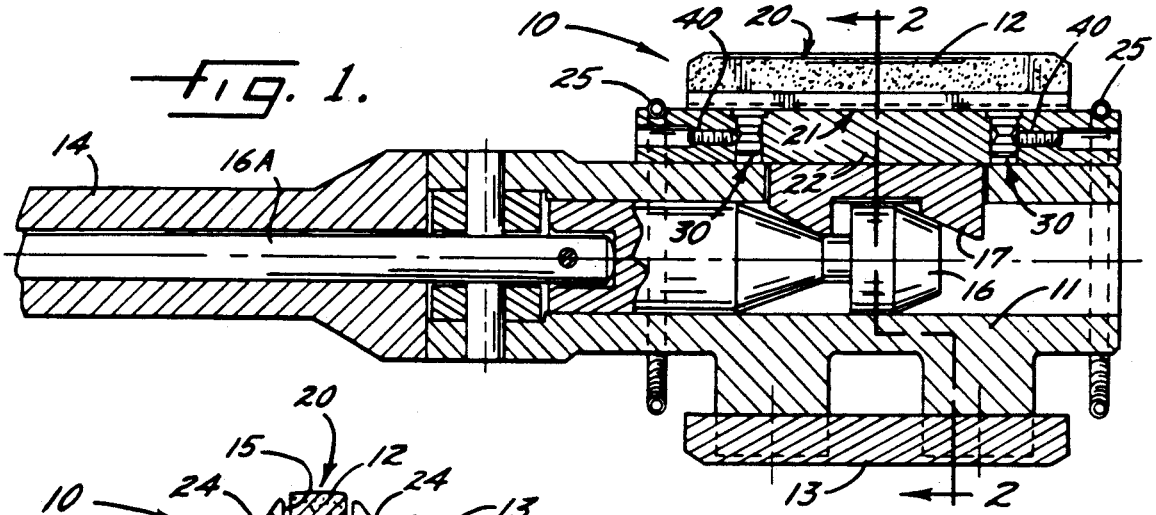
FIG. 1 is a cross-sectional view taken axially through a typical honing tool equipped with new and improved stone assemblies incorporating the unique features of the present invention.

The present invention is shown in the drawings in connection with a honing tool 10 for use in smoothing a bore in a workpiece (e.g., the cylinder of an engine block). The tool includes a hone body 11 with several (herein, ten) angularly spaced stones 12 in the shape of elongated sticks made of bonded abrasive material. During a honing operation, the body 11 is rotated and reciprocated to cause the sticks 12 to smooth the wall of the bore. Conventional guides 13 are located between the sticks.

Figure 2:
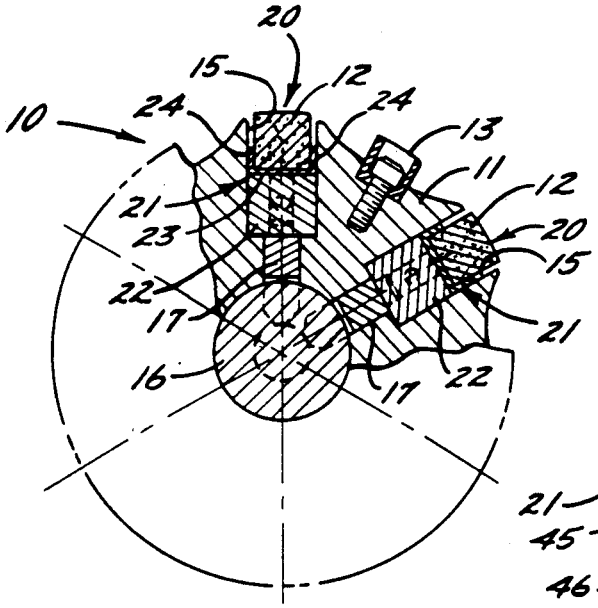
FIG. 2 is an enlarged fragmentary cross-section taken substantially along the line 2—2 of FIG. 1.

The hone body 11 is carried on the end of an elongated spindle 14 which is adapted to be rotated and reciprocated. As shown in FIG. 2, the sticks 12 are located in angularly spaced slots 15 formed in the body. As the sticks wear, they are adapted to be expanded radially outwardly. For this purpose, an expansion cone 16 (FIG. 1) is carried on the end of a rod 16A which is advanced endwise under automatic control. When the rod is advanced from left-to-right in FIG. 1, the cone engages followers 17 to force the sticks outwardly.

Each stick 12 is rectangular in cross-section and forms part of a honing stone assembly 20. In addition to the stick, each stone assembly 20 includes a shell 21 and a holder 22. The shell 21 is made of sheet metal and is generally channel-shaped or C-shaped in cross-section. Thus, the shell includes an inner web 23 having two integral flanges 24 projecting outwardly from its side margins. The stick 12 fits in the shell between the flanges 24 and is located with its inner non-working face lying against the web 23. The stick is captivated in the shell by cement.

The stone holder 22 is disposed in the slot 15 and comprises an elongated bar-like member whose outer side is secured to the shell 21 and whose inner side rides on the follower 17. Garter springs 25 (FIG. 1) encircle the end portions of the holder and cause the stone assembly 20 to move inwardly when the cone 16 is retracted.

In accordance with the present invention, the shell 21 is detachably secured to the holder 22 by unique studs 30 which extend radially so as to avoid occupying any space in the slot 15 at the sides of the stone assembly 20. By virtue of the radially extending retaining studs 30, the slots 15 may be made relatively narrow in the circumferential direction in order to enable a relatively large number of stone assemblies to be incorporated into a hone body 11 of a given diameter.

Figure 3:
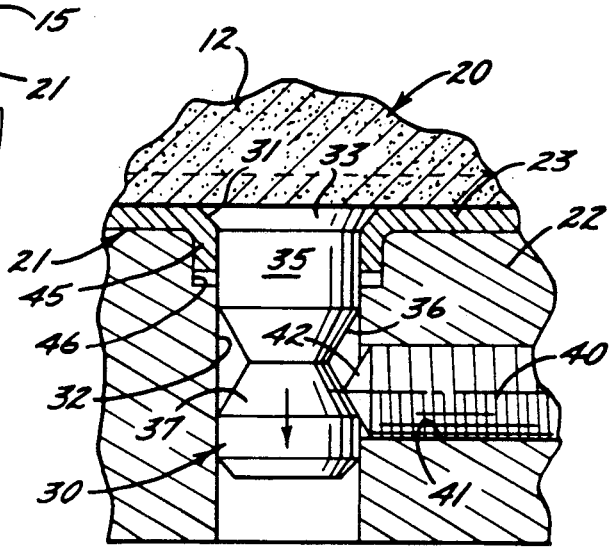
FIG. 3 is a greatly enlarged cross-sectional view of parts of one of the stone assemblies shown in FIG. 1.
Figure 4:
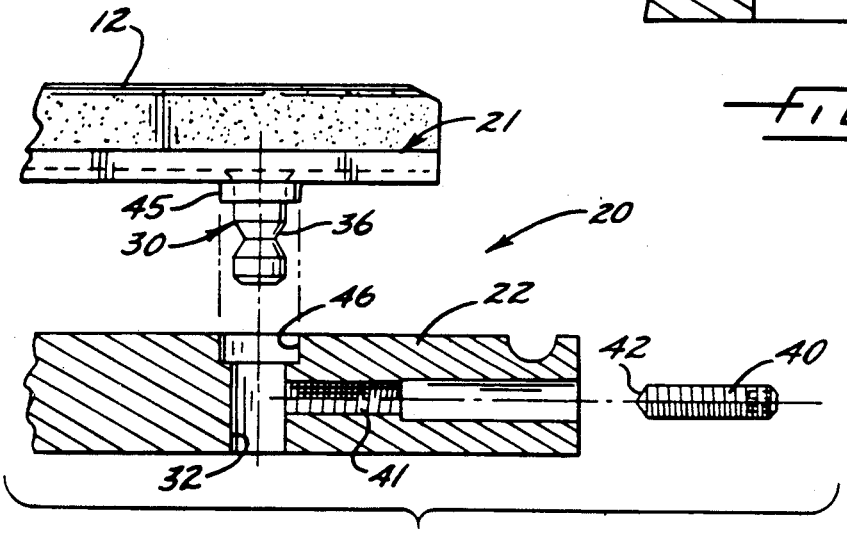
FIG. 4 is a view partly in elevation and partly in section and showing the stone and the shell in exploded relation with respect to the stone holder.

More specifically, the present stone assembly 20 utilizes two identical retaining studs 30, there being one stud located adjacent each end portion of the assembly. Each stud extends through a hole 31 (FIG. 3) formed through the web 23 of the shell 21 and into an alined hole 32 extending radially through the holder 22. The hole 31 is beveled and receives an enlarged and similarly beveled head 33 at the outer end of the stud. As a result, the outer surface of the head is either flush with or is located inwardly of the outer surface of the web 23 so as to enable the stick 12 to lie flat against the web. Engagement of the head 33 with the stick 12 prevents the stud 30 from shifting radially outwardly.

Each stud 30 further includes a shank 35 (FIG. 3) located in the hole 32 in the holder 22 and formed with an annular groove 36 which extends circumferenetially around the stud. The groove is formed by a turning tool or other means and is advantageously shaped such that its inner wall 37 is substantially frustoconical.

The studs 30 are assembled with the shell 21 before the stick 12 is placed in and bonded to the shell. Assembly of the stick and shell sub-unit with the holder 22 is effected by telescoping the shanks 35 of the studs 30 into the holes 32 in the holder. To secure the shell 21 to the holder 22, a set screw 40 is located in a tapped hole 41 formed in each end portion of the holder. The set screw extends perpendicular to the stud and, when the screw is tightened, its end moves into the groove 36 and engages the wall 37 thereof to clamp the stud. Advantageously, the end of the screw is defined by a cone point 42 which, as the screw is tightened, cams against the frustoconical wall 37 to draw the shell 21 inwardly into tight clamping engagement with the holder 22. This provides a very positive retaining force to resist the turning moments applied to the shell during honing and to prevent the shell from tending to roll away from the holder.

Because the studs 30 extend radially inwardly from the shell 21, the circumferential width of the shell may be made equal to the width of the holder 22, and no side clamps are required in the slots 15. This circumferentially compact retention structure enables the slots 15 to be made narrow and enables a greater number of stone assemblies 20 with channel-shaped sheet metal shells 21 to be placed in a hone body 11 of a given diameter in order to produce a better honed finish and a more precise geometry. By way of example, the present retention structure enables six stone assemblies to be placed in a 3⅛ inch diameter body whereas only four conventional assemblies with side clamps previously could be placed in a body of that diameter.

When the stick 12 wears out, the screw 40 is loosened to permit the removal of the stick/shell sub-unit. The sub-unit then is discarded along with the studs 30 and is replaced with a new sub-unit. The screws 40 need not be completely removed from the holes 41 during changeover and thus there are no loose parts.

While the studs 30 clamp the shell 21 to the holder 22 and resist torque loads, they are not used as the primary resistance against end thrust imposed on the stick 12. To resist end thrust, short cylindrical bosses 45 (FIG. 3) are depressed inwardly from the web 23 around the holes 32. The bosses dowel tightly into counterbores 46 at the outer ends of the holes 32 and provide a positive axial lock.

We claim:

1. A honing stone assembly comprising an elongated abrasive stick having an outer working face and an inner non-working face, a shell secured to said stick and having an inner web lying against the non-working face of said stick, a hole formed through said web and disposed in opposing relation with the non-working face of said stick, a mounting stud extending slidably through said hole and projecting inwardly from said web, said stud having an enlarged outer end portion engageable with said web to retain said stud against inward movement through said hole and engageable with the non-working face of said stick to retain said stud against outward movement through said hole, and an elongated holder for said shell and said stick, said holder having a hole receiving said stud, means for releasably anchoring said stud in said hole in said holder thereby to secure said shell and said stick to said holder, said means comprising a screw threaded into said holder and having an end engaging said stud, said screw extending substantially perpendicular to said stud.

2. A honing stone assembly as defined in claim 1 further including a tubular boss formed integrally with and projecting inwardly from said web and encircling a portion of said stud.

3. A honing stone assembly comprising an elongated abrasive stick having an outer working face and an inner non-working face, an elongated shell for holding said stick, said shell being generally channel-shaped and having an inner web and a pair of flanges projecting outwardly from said web, a pair of holes formed through and spaced along said web, a pair of mounting studs extending slidably through said holes and projecting inwardly from said web, said studs having inner end portions and having enlarged outer end portions, said outer end portions being engageable with said web to limit inward movement of said studs through said holes, said stick being captivated in said shell between said flanges and being positioned with said non-working face lying against said web and in opposing relation with the outer end portions of said studs to limit outward movement of said studs, and an annular groove formed in and extending circumferentially around the inner end portion of each stud.

4. A honing stone assembly as defined in claim 3 in which each groove includes an outwardly facing and outwardly tapered wall portion.

5. A honing stone assembly as defined in claim 3 further including an elongated holder for said shell and said stick, said holder having a pair of holes receiving said studs, and means for releasably anchoring said studs in the holes in said holder thereby to secure said shell and said stick to said holder.

6. A honing stone assembly as defined in claim 5 in which said means comprise screws threaded into said holder and having end engaging said studs, said screws extending substantially perpendicular to said studs.

7. A honing stone assembly comprising (a) an elongated abrasive stick having an outer working face and an inner non-working face, (b) an elongated shell for holding said stick, and (c) a holder for said shell, said shell being generally channel-shaped and having an inner web and a pair of flanges projecting outwardly from said web, a pair of holes formed through and spaced along said web, a pair of mounting studs extending slidably through said holes and projecting inwardly from said web; said studs having enlarged outer end portions engageable with said web to limit inward movement of said studs, said stick being captivated in said shell between said flanges and being positioned with said non-working face lying against said web and in opposing relation with the outer end portions of said studs to limit outward movement of said studs, a pair of holes formed in said holder and receiving said studs, and means for releasably anchoring said studs in the holes in said holder, said means comprising screws threaded into said holder and having ends engaging said studs, said screws extending substantially perpendicular to said studs.

8. A honing stone assembly as defined in claim 7 further including an annular groove formed in and extending circumferentially around the inner end portion of each stud, the ends of said screws being received in said grooves.

9. A honing stone assembly as defined in claim 8 in which each groove includes an outwardly tapered wall portion, the ends of said screws engaging said wall portions and pulling said studs inwardly as said screws are tightened.

10. A honing stone assembly as defined in claim 9 in which the end of each screw is substantially conical.

11. A honing stone assembly as defined in claim 7 further including tubular bosses formed integrally with and projecting inwardly from said web, said bosses encircling portions of said studs and projecting snugly into the holes in said holder.

12. A honing stone assembly comprising an elongated abrasive stick having an outer working face and an inner non-working face, an elongated shell for holding said stick, said shell being generally channel-shaped and having an inner web and a pair of flanges projecting outwardly from said web, a pair of holes formed through and spaced along said web, a pair of mounting studs extending slidably through said holes and projecting inwardly from said web, said studs having inner end portions and having enlarged outer end portions, said outer end portions being engageable with said web to limit inward movement of said studs through said holes, said stick being captivated in said shell between said flanges and being positioned with said non-working face lying against said web and in opposing relation with the outer end portions of said studs to limit outward movement of said studs, an elongated holder for said shell and said stick, said holder having a pair of holes receiving said studs, and means for releasably anchoring said studs in the holes in said holder thereby to secure said shell and said stick to said holder, said means comprising screws threaded into said holder and having ends engaging said studs, said screws extending substantially perpendicular to said studs.

13. A honing stone assembly as defined in claim 12 further including an annular groove formed in and extending circumferentially around the inner end portion of each stud, the ends of said screws being received in said grooves.

14. A honing stone assembly as defined in claim 13 in which each groove includes an outwardly facing and outwardly tapered wall portion, the ends of said screws engaging said wall portions and pulling said studs inwardly as said screws are tightened.

15. A honing stone assembly as defined in claim 14 in which the end of each screw is substantially conical.

* * * * *